US005413266A

United States Patent [19]

Jairam

[11] Patent Number: 5,413,266

[45] Date of Patent: May 9, 1995

[54] COMPACT GEAR ARM POWERED STAPLER WITH MOVABLE ANVIL

[75] Inventor: Sarwan A. Jairam, Richmond Hill, N.Y.

[73] Assignee: Acco USA, Inc., Wheeling, Ill.

[21] Appl. No.: 226,909

[22] Filed: Apr. 13, 1994

Related U.S. Application Data

[63] Continuation-in-part of Ser. No. 80,373, Jun. 18, 1993, abandoned, which is a continuation-in-part of Ser. No. 3,340, Jan. 12, 1993, abandoned, which is a continuation of Ser. No. 940,934, Sep. 3, 1992, abandoned, which is a continuation of Ser. No. 761,102, Sep. 17, 1991, abandoned.

[51] Int. Cl.[6] ..... B25C 5/02

[52] U.S. Cl. ..... 227/129; 227/155

[58] Field of Search ..... 227/131, 155, 5, 129

[56] References Cited

U.S. PATENT DOCUMENTS

| | | | |
|---|---|---|---|
| 3,524,575 | 8/1970 | Hurkmans et al. | 227/131 |
| 4,194,666 | 3/1980 | Spehrley, Jr. et al. | 227/155 |
| 4,199,095 | 4/1980 | Yamanoi | 227/155 |
| 4,593,847 | 6/1986 | Hagemann | 227/155 |
| 4,720,033 | 1/1988 | Olesen | 227/155 |
| 4,726,505 | 2/1988 | Okazaki | 227/155 |
| 4,844,319 | 7/1989 | Kurosawa | 227/155 |
| 5,007,572 | 4/1991 | Chung-Cheng | 227/131 |
| 5,009,355 | 4/1991 | Akizawa et al. | 227/155 |
| 5,195,671 | 3/1993 | Shimomura et al. | 227/5 |

*Primary Examiner*—Scott A. Smith
*Attorney, Agent, or Firm*—Pennie & Edmonds

[57] ABSTRACT

A stapler powered by a motor and gear train to move a head up and down through utilization of at least one pivotal arm having an elongated cam follower slot in the arm; a driven rotatable gear in the train gear and a pin on the gear to ride in and along the slot. The arm pivots about a spring-loaded axle. Clinching wings for clinching staples are positively driven upwardly and downwardly by a pivotal clinching arms. A manual unit is included for turning the gear train to assist in removing jams.

6 Claims, 12 Drawing Sheets

COMPACT GEAR ARM POWERED STAPLER WITH MOVABLE ANVIL

RELATED APPLICATIONS

This application is a continuation-in-part of U.S. patent application Ser. No. 08/080,373 filed Jun. 18, 1993 entitled "Compact Gear Arm Powered Stapler With Movable Anvil", now abandoned which is a continuation-in-part of U.S. patent application Ser. No. 08/003,340 filed Jan. 12, 1993, now abandoned which in turn was a continuation of U.S. patent application Ser. No. 07/940,934 filed Sep. 3, 1992, now abandoned which was a continuation of U.S. patent application Ser. No. 07/761,102 filed Sep. 17, 1991, now abandoned the last two (2) applications entitled "Compact Gear Arm Powered Stapler".

BACKGROUND OF THE INVENTION

Motor powered staplers using cranks with arms attached to the cranks have been proposed and used (U.S. Pat. Nos. 4,720,033 an 4,844,319) but such staplers have lacked quiet operation, compactness and have not provided the control of head and blade movement required for many stapling applications.

SUMMARY OF THE INVENTION

Briefly, the invention comprises a powered stapler with head and driver blade having a blade holder controlled by at least one arm pivotally mounted on a spring loaded shaft. The arm engages the holder through compensation slots in the forward portion of the arm and the arm further includes a configured cam slot in its rearward portion for engaging a motor driven bull gear mounted pin which moves with the bull gear in a circular path. As the driven pin moves through one revolution, the head and blade are controllably lowered for stapling and raised to ready the stapler for a subsequent cycle. Clinching wings are positively driven upwardly to clinch a staple and the wings are positively driven downwardly to positions which make them ready for the next driving cycle.

It is a feature that the arm shaft is spring loaded to compensate for the thickness of the stack being stapled.

DESCRIPTION OF THE PREFERRED EMBODIMENT

Figure 1:
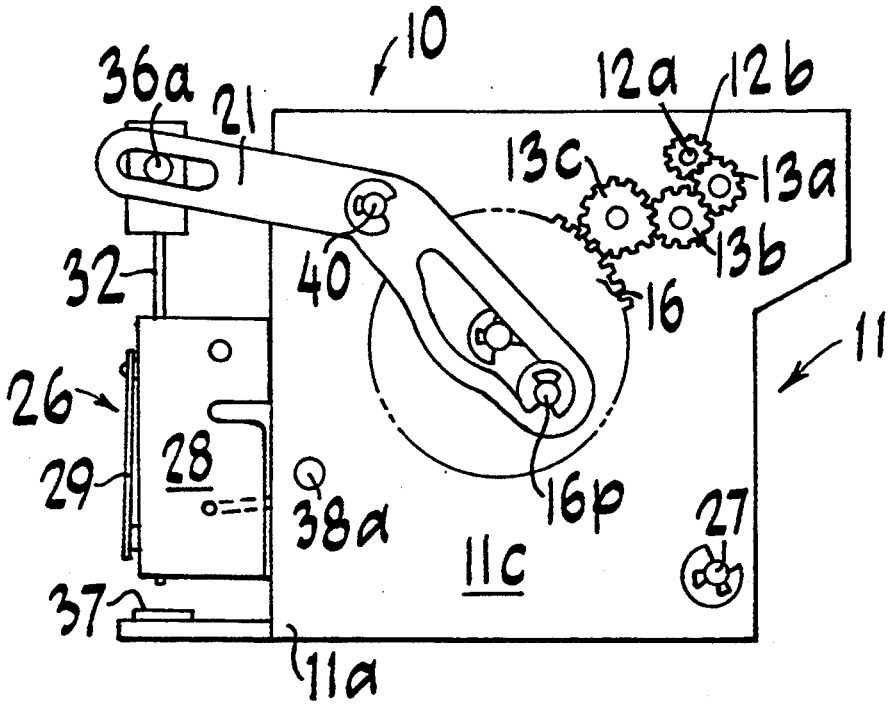
FIG. 1 is a side elevational view of the left side of the powered stapler.
Figure 1A:
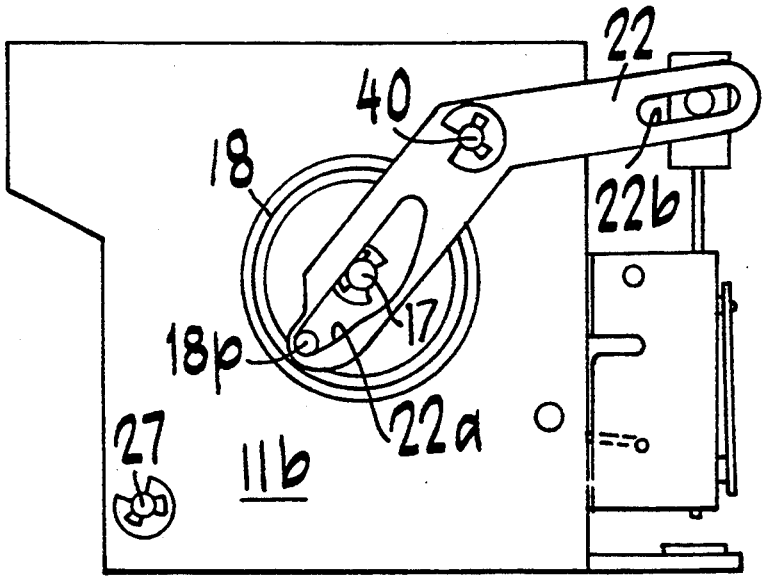
FIG. 1*a* is a side elevational view of the right side of the powered stapler.
Figure 2:
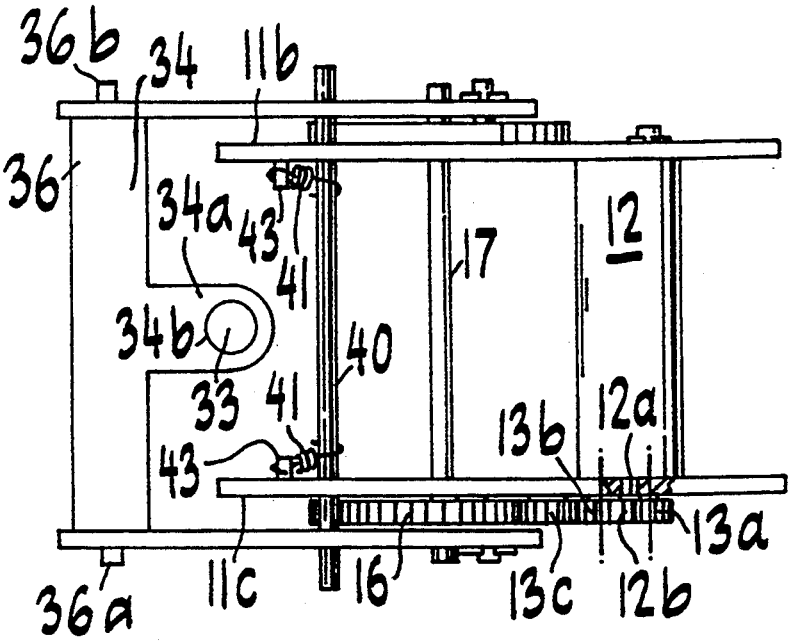
FIG. 2 is a top view of the stapler.

In FIGS. 1, 1*a* and 2, powered stapler 10 includes frame 11 comprising base plate 11*a*, and two spaced-apart upright left and right frame plates 11*b*, 11*c*. Motor 12, mounted between right plate 11*b* and left plate 11*c*, has motor shaft 12*a* which protrudes through left plate 11*c* and carries at its end a driver spur 12*b*. Spur 12*b* in turn drives first reduction gear 13*a* which drives second reduction gear 13*b* which drives third reduction gear 13*c* which drives bull gear 16 counterclockwise (as viewed in FIG. 1). The spring gear 12*b* and reduction gears 13*a–c* lie substantially in a plane. Bull gear 16 is secured to bull shaft 17 which bull shaft 17 is secured to follower gear 18 (see FIG. 1*a*). When bull gear 16 turns follower gear 18 turns with it.

Left driver arm 21 and right driver arm 22 rotate about horizontal spring mounted arm shaft 40. Driver arms 21, 22 include at the rearward ends left and right cam elongated follower slots 21*a*, 22*a* and at the forward ends left and right compensation slots 21*b*, 22*b*. Arms 21, 22 are driven by bull gear driver pin 16*p* and follower gear driver pin 18*p* respectively as pins 16*p*, 18*p*, each of which is affixed to bull gear 16 and follower gear 18 respectively, are carried in circular paths during the staplet's cycling. Thus, pin 16*p*, 18*p*, drive right and left arms 21, 22 are substantially balanced for forces. It is contemplated that a single centered driver arm may be used as an alternative.

Also shown are pivotal stapler head 26 pivotal about pin 27 mounted in frame 11 which head 26 includes sheath 28, former spring 29, driver blade 32 and upstanding post 33. The upper end of blade 32 is secured to blade T-section holder 34 including cross piece 36 which carries left end pin 36*a* inserted in arm slot 21*a* and right pin 36*b* inserted in slot 22*a*. T-section holder 34 also includes extension 34*a* with hole 34*b*. Hole 34*b* provides guiding of holder 34 during its up and down movement guided by head mounted post 33. Since head 26 swings about pivot pin 27 all parts of head 26 including blade 32 swing through arcs including T-section 34 thus requiring the elongated arms slots 21*b*, 22*b* to avoid jamming.

Figure 3A:
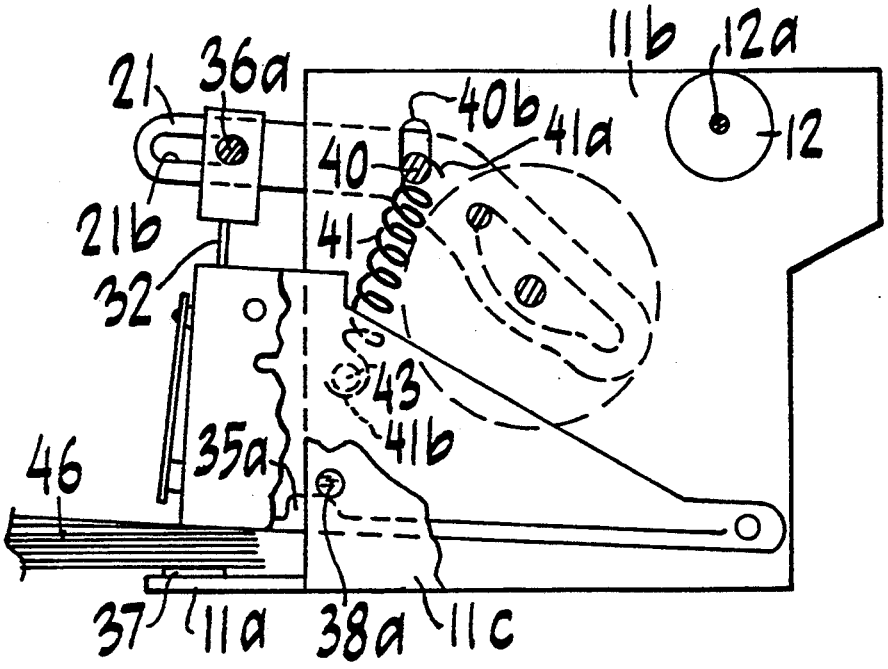
FIG. 3*a* is a partial cutaway side elevational view showing the spring mounted arm pivot shaft in a position of the stapling cycle.

Also shown in FIGS. 1 and 1*a* are anvil 37, head left and right stop pins 38*a*, 38*b* which extend through and into the interior of plates 11*a*, 11*b*. Turning to FIG. 3*a*, pins 38*a*, 38*b* engage left and right stops 35*a*, 35*b* on head 26 during upward movement of head 26 after stapling (FIG. 1). Stop 35*b* is not shown in the drawings. The right stop 35*b* is hidden in the FIG. 3*a* view.

Figure 3B:
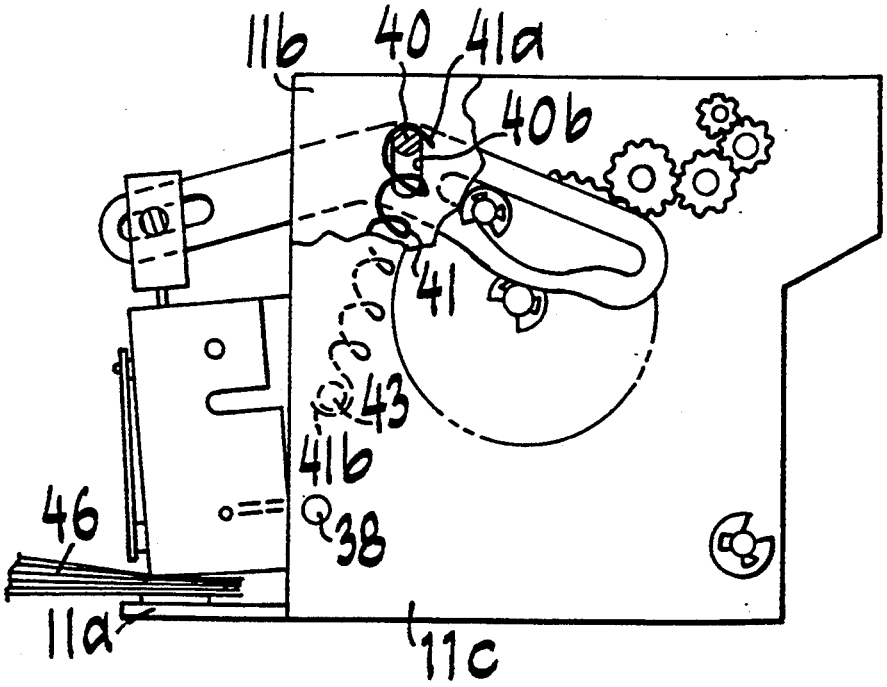
FIG. 3*b* is also a partial cutaway view in which the driver blade engages a thick stack of sheets and the pivot shaft rises against the spring tension.

Turning to FIGS. 3*a* and 3*b*, arm shaft 40 is mounted in vertically elongated plate openings 40*a*, 40*b*, formed respectively in plates 11*b* and 11*c* with springs 41, 42. Plate 11*c* is only partially shown in FIGS. 3*a*, and plate 11*b* is also partially shown in FIG. 3*b*. Openings 40*a*, 40*b* are substantially larger than the cross-section of shaft 40. Springs 41, 42 have upper hooks 41*a*, 42*a*; lower hooks 41*b*, 42*b* and resilient sections 41*c*, 42*c*. Springs 41, 42 are sized and shaped so that as they are mounted in tension on stationary frame studs 43, 44. Shaft 40 is urged downwardly and sits on the lower end of opening 40*a*. When a stack 46 of for example ten sheets is engaged by blade 32, shaft 40 will rise up above lower end of the opening 40*a* compensating for the thickness of stack 46.

Figure 4A:
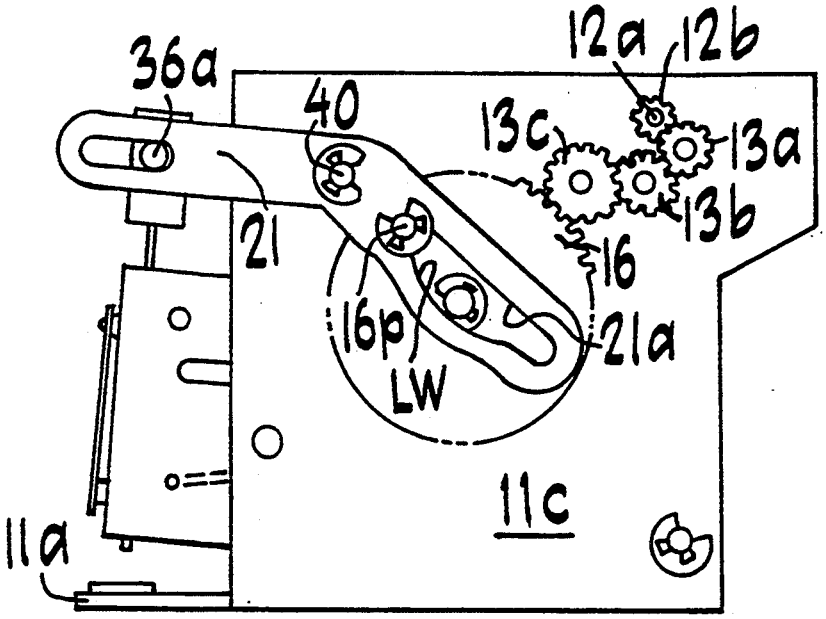
FIG. 4*a* is a side elevational view showing the bull gear driver pin at a selected position in configured arm cam follower slot.
Figure 4B:
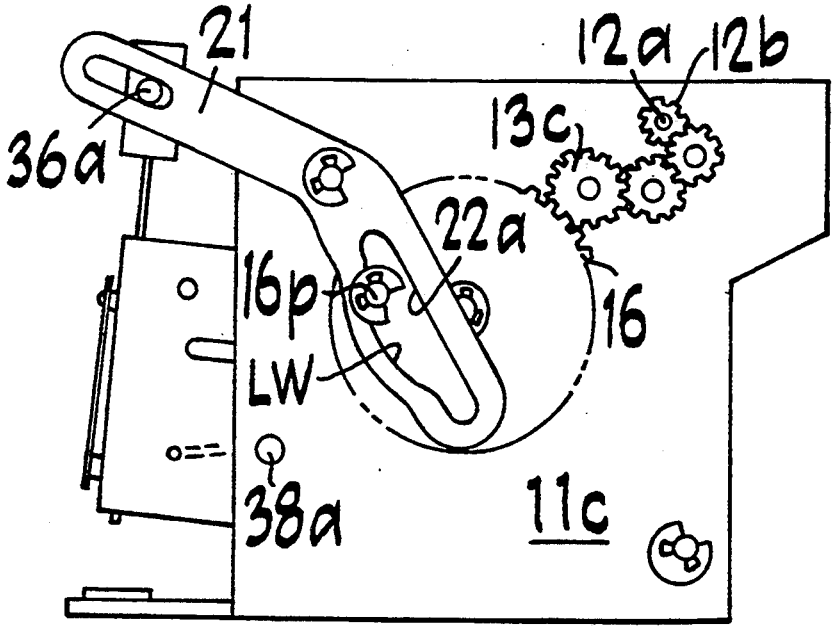
FIG. 4*b* is a side elevational view showing the bull gear driver pin at a different position in configured arm cam follower slot.
Figure 4C:
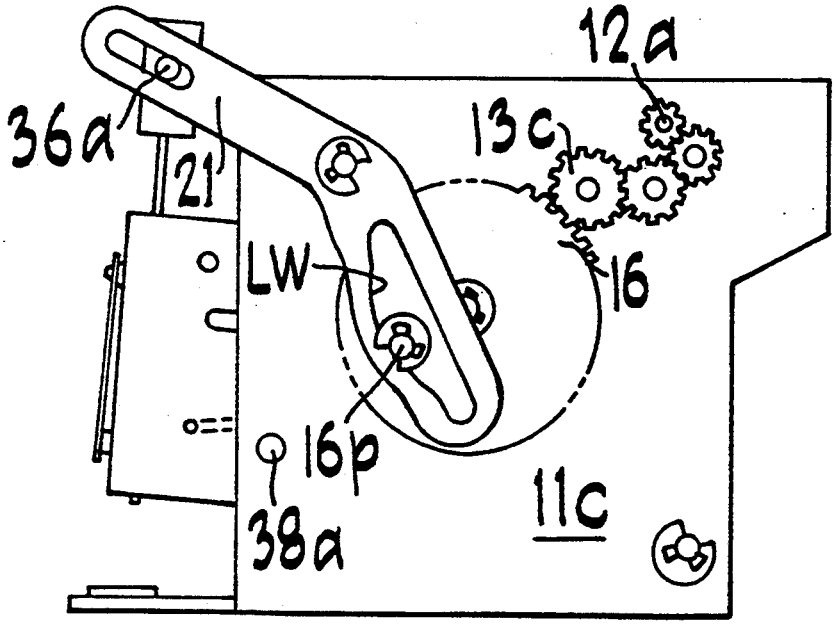
FIG. 4*c* is a side elevational view showing the bull gear driver pin at a different position in configured arm cam follower slot.
Figure 4D:
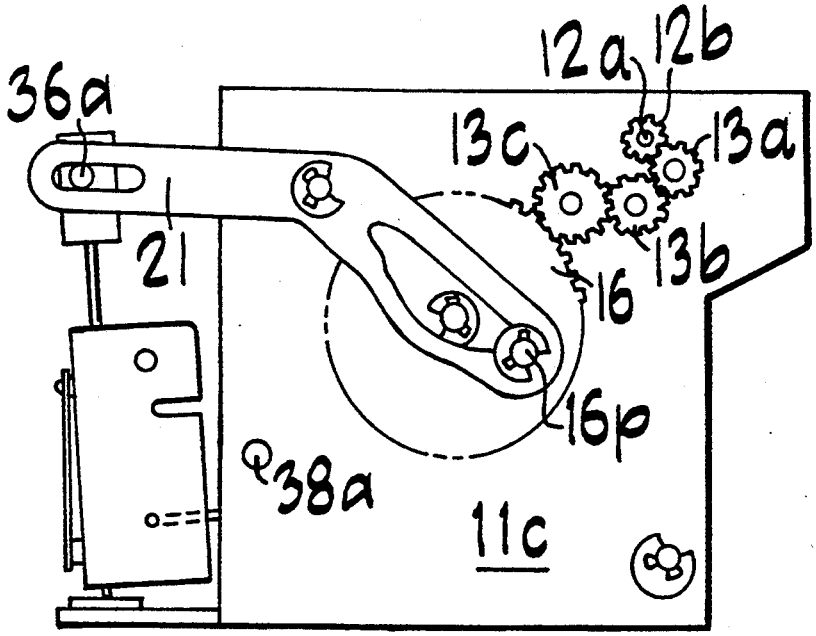
FIG. 4*d* is a side elevational view showing the bull gear driver pin at a different position in configured arm cam follower slot.
Figure 4E:
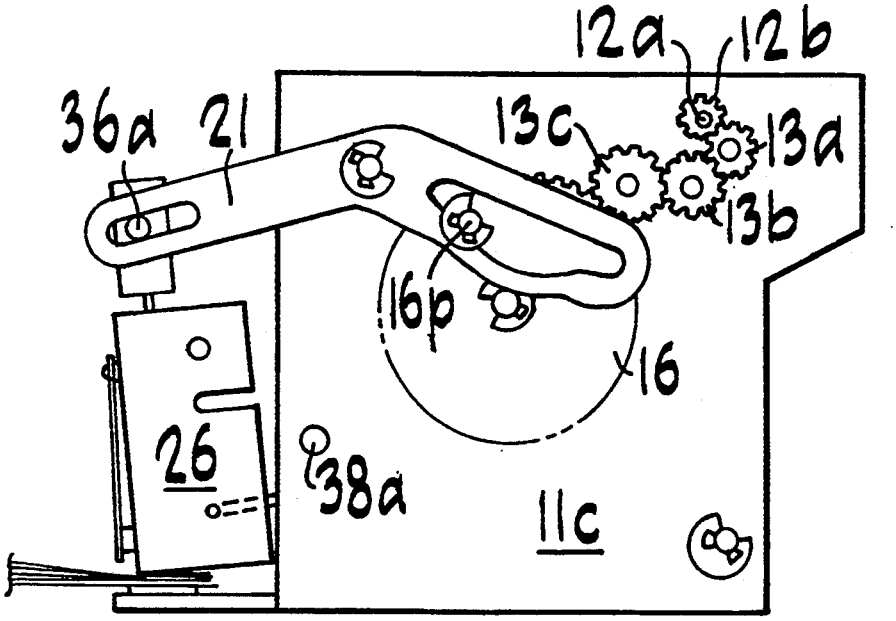
FIG. 4*e* is a side elevational view showing the bull gear driver pin at a different position in configured arm cam follower slot.
Figure 5:
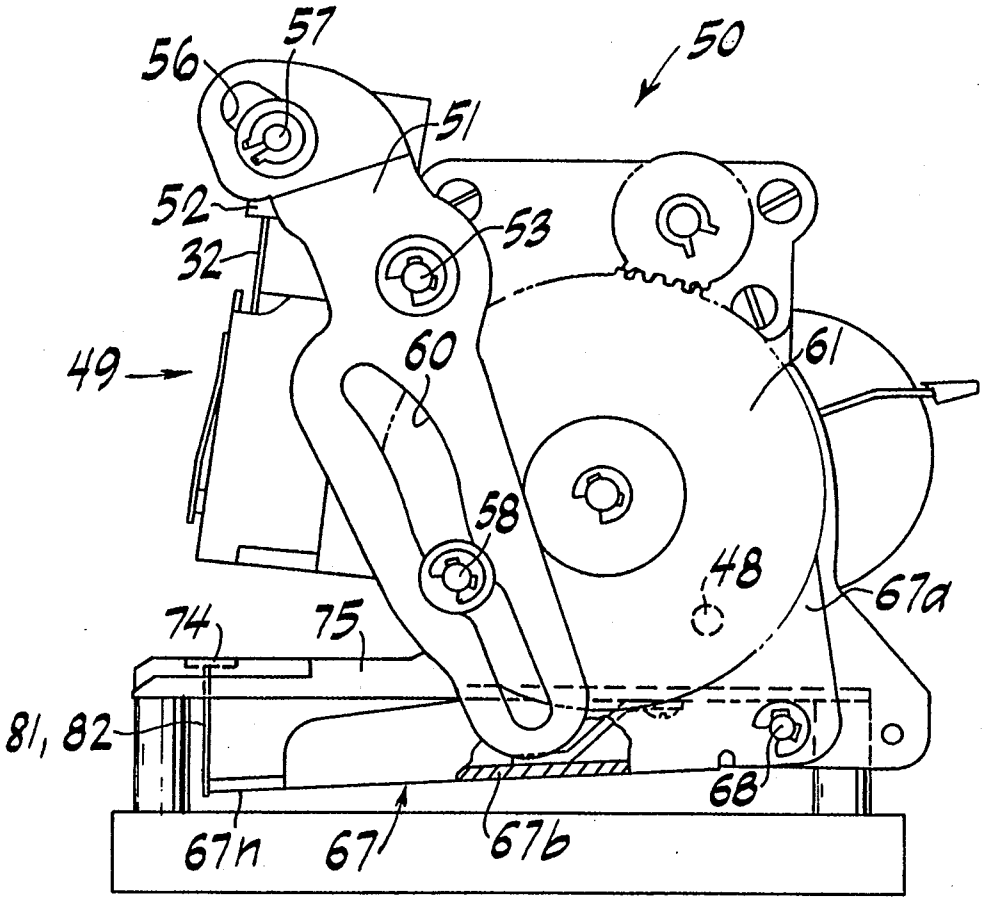
FIG. 5 is a side elevational view of the second embodiment of the stapler of the present invention with the stapler head in an up position and having a clinching arm in a down position.
Figure 5A:
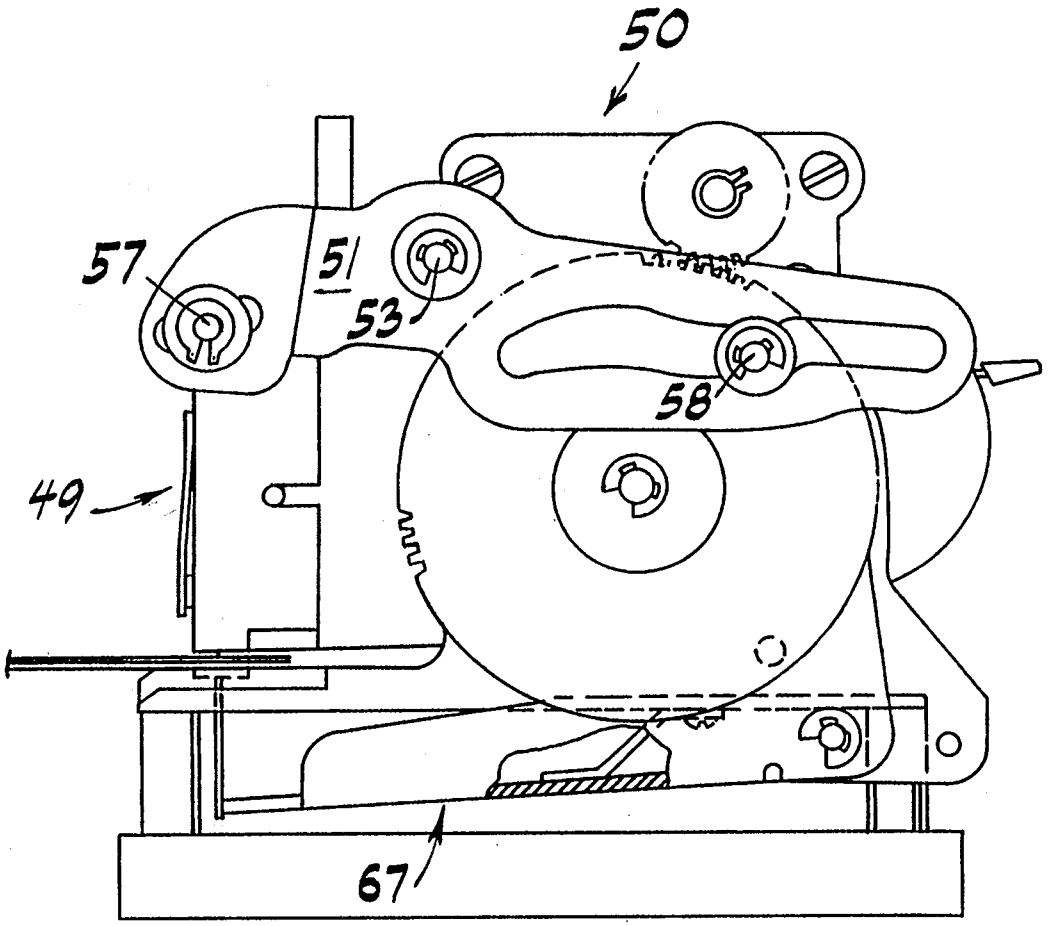
FIG. 5*a* is a view similar to FIG. 5 with both the head and clinching arm down.

Referring to FIGS. 4*a*, 4*b*, 4*c* and 4*d*, and initially to FIG. 4*a*, stapler head 26 is shown in an intermediate position in which head 26 has risen as high as it can go due to stops 35*a*, 35*b*. As driven pin 16*p* rotates clockwise, it engages compensation slot 22*a*, lower wall LW moving it downwardly to raise blade 32 to its upper position (FIG. 4*b*). Once pin 16*p* engages the curved wall portion of lower wall LW, pin 16*p* exerts a minor turning moment to arm 22 (see FIG. 4*c*). When pin 16*p* starts to move upward (FIG. 1), arm 22 rotates clockwise pushing arm 22 downward which in turn moves head 26 down against the paper stack 46 as rotation continues (FIG. 4*d*). Finally, arm 22 rotation brings blade 32 down to form and drive the staple (FIG. 4*e*).

An alternative embodiment is shown in FIGS. 5–11 in which stapler 50 has swingable head 49 pivoted about pivot 48. Stapler head 49 supports blade housing 52. Stapler 50 further includes arm 51 pivoted about pivot 53 which arm is connected to blade housing 52 through forward arm opening 56 and head pin 57. Arm 51 is driven by drive pin 58 acting within opening 60. Pin 58 is mounted on drive gear 61. Clinching anvil wings 81, 82 (see also FIGS. 8, 9 and 10) are moved upwardly by clinching arm 67 pivoted about pivot 68 to clinch and downwardly by anvil drive arm 67.

Figure 6:
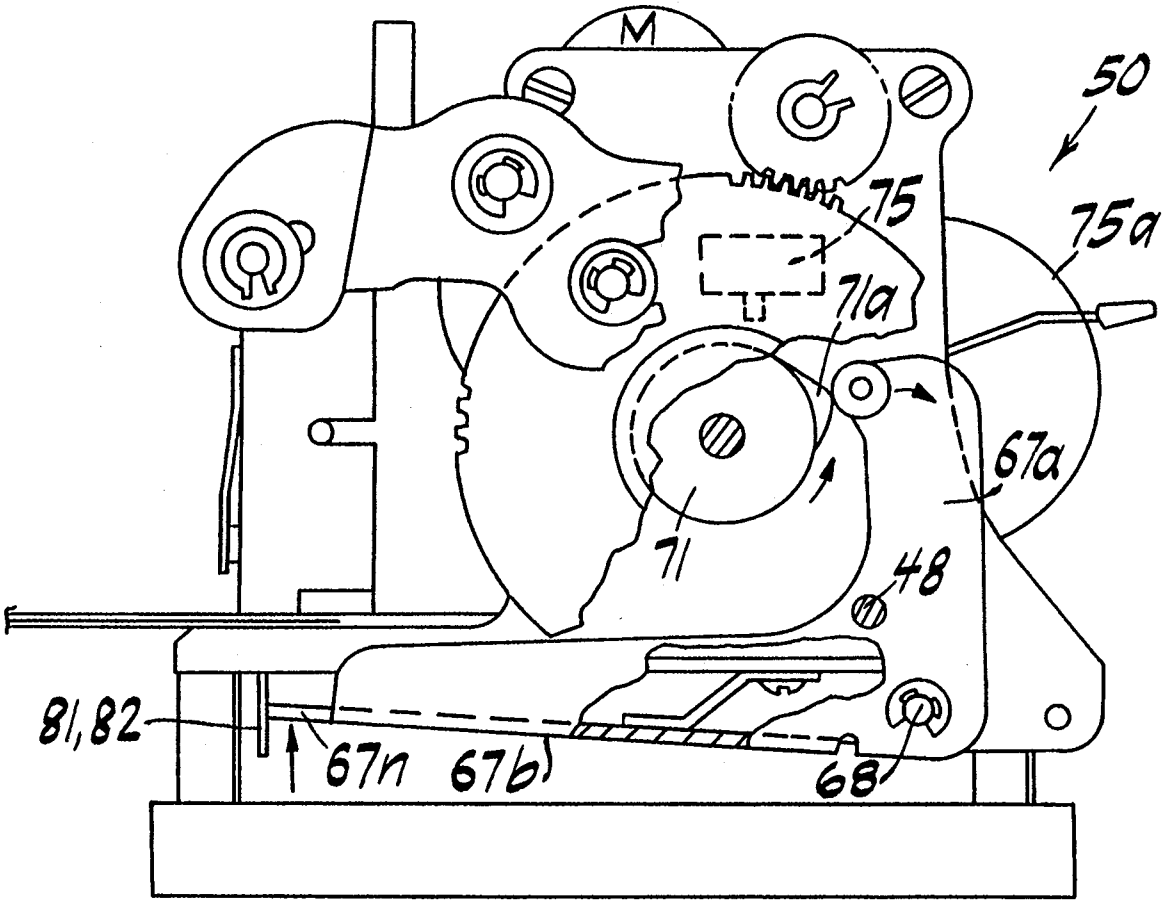
FIG. 6 is a view similar to FIG. 5 with the head down and the clinching arm up.

Staple clinching arm 67 includes upper arm portion 67*a* and lower arm portion 67*b*. Upper arm portion 67*a* is caused to pivot about pivot 68 by rotatable cam wheel 71 including eccentric portion 71*a* (FIG. 6). Pivots 48 and 68 are spaced apart. Eccentric portion 71*a* also engages switch 75*a* of switch unit 75 to stop the stapler as it reaches the completion of the stapling cycle.

Figure 7:
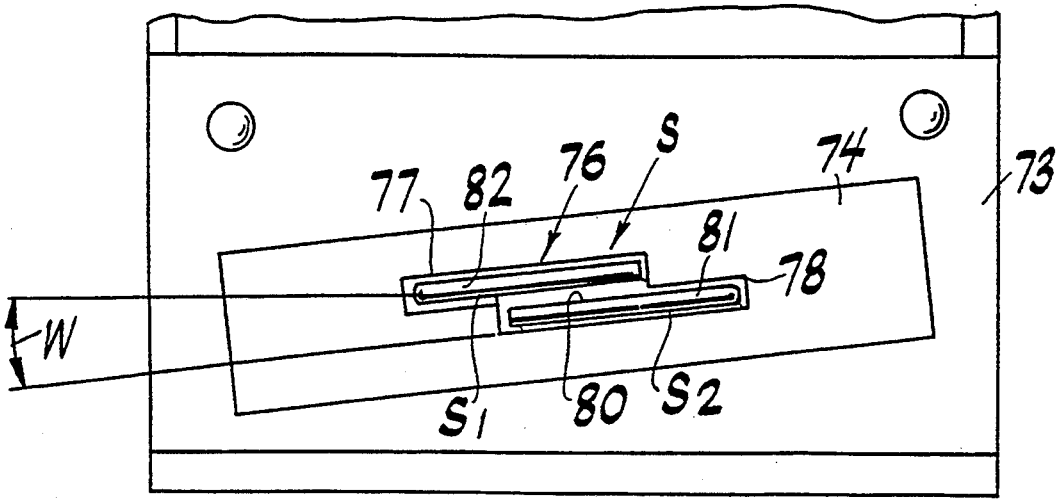
FIG. 7 is a partial plan view showing the anvil insert with bent staple legs therein.

Turning to FIG. 7, there is shown base plate 73 attached to frame base 75 with anvil insert 74 at angle W positioned therein. Insert 74 has configured opening 76 which opening in turn includes staple first leg receiving portion 77, second staple leg receiving portion 78 and spacer portion 80 between portions 77, 78. Staple S shown with legs $S_1$, $S_2$ in clinched position.

Figure 8A:
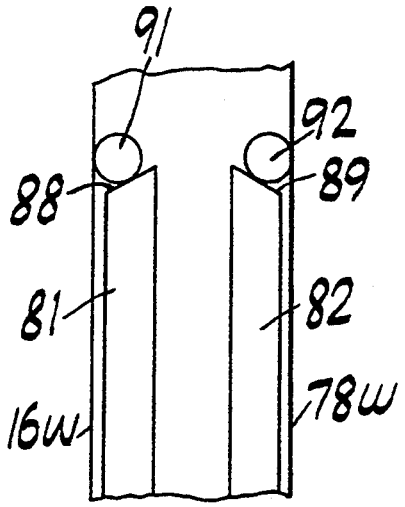
FIG. 8*a* is a partial sectional view showing alternative clamping wings with angled top surfaces engaging the staple legs.
Figure 8:
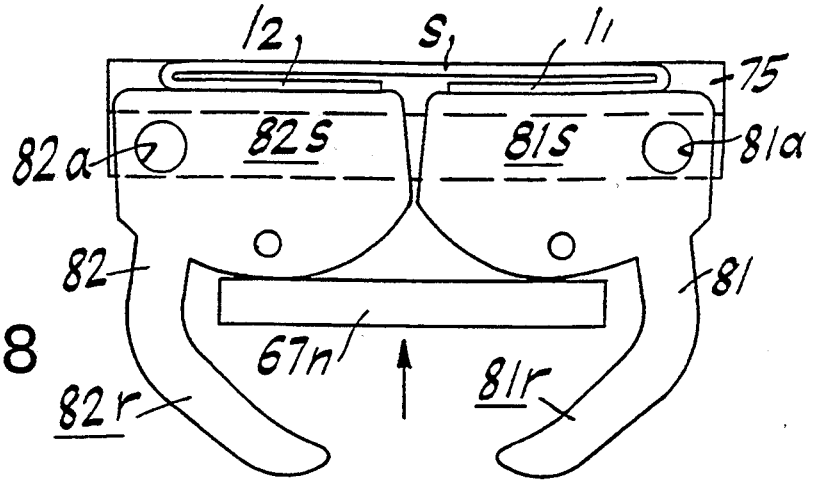
FIG. 8 is an elevational view of the clinching wings having fully bent the staple legs.
Figure 9:
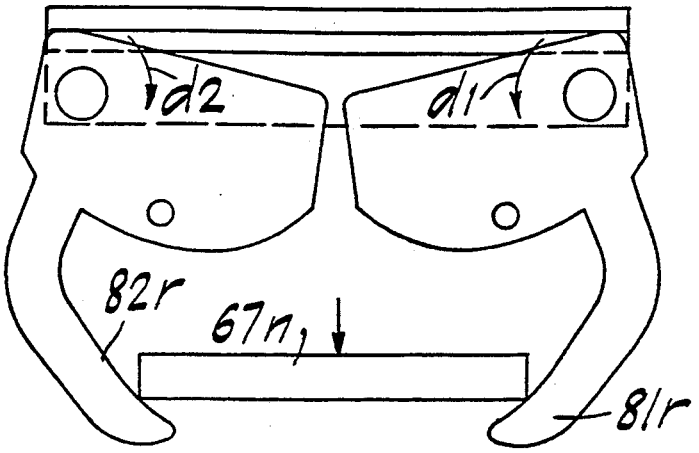
FIG. 9 is an elevational view of the wings starting down under force of the arm.
Figure 10:
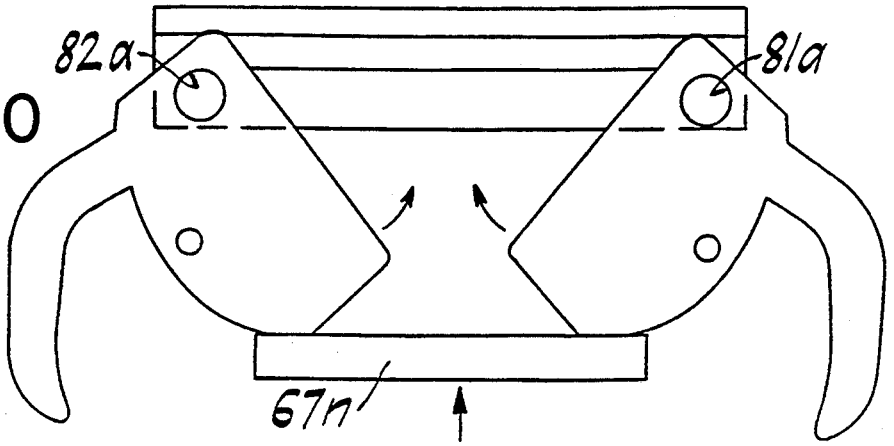
FIG. 10 is an elevational view of the wings in the full rotated position ready to start backup to clinch.

Turning next to FIGS. 8, 9 and 10, shown are clamping (clinching) wings 81, 82 pivoted about pivots 81*a*, 82*a*. Each wing 81, 82 includes staple-engagement portion 81*s*, 82*s* and return projections 81*r*, 82*r*. Wings 81,82 are moved by clinching drive arm nose 67*n*. FIG. 8 shows wings 81, 82 in their up position clinching staple S. FIG. 9 shows arm nose 67*n* moving down in engagement with return projections 81*r*, 82*r* to rotate wings 81, 82 in directions d1, d2. Gravity also causes such rotation with arm nose 67*n* assuring the return of wings 81, 82 to their ready-to-start-clinching positioning shown in FIG. 10.

Figure 11:
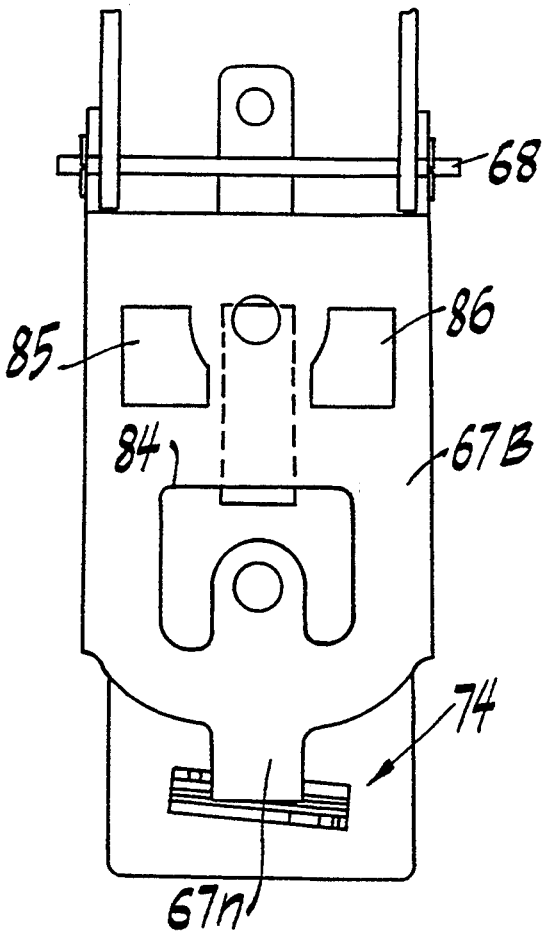
FIG. 11 is a bottom view of the lower arm portion.

FIG. 11 is a sectional bottom view of arm 67 including portion 67*b* with nose 67*n* and openings 84, 85 and 86. Also shown is pivot axle 68.

FIG. 8*a* shows alternatively shaped clinching wings 81', 82' having upper angled surfaces 88, 89 respectively which engage staple legs 91, 92 to lift and bend such legs as they move apart and are guided by wall 76*w* of portion 76' and wall 78*w* of portion 78'.

Figure 11A:
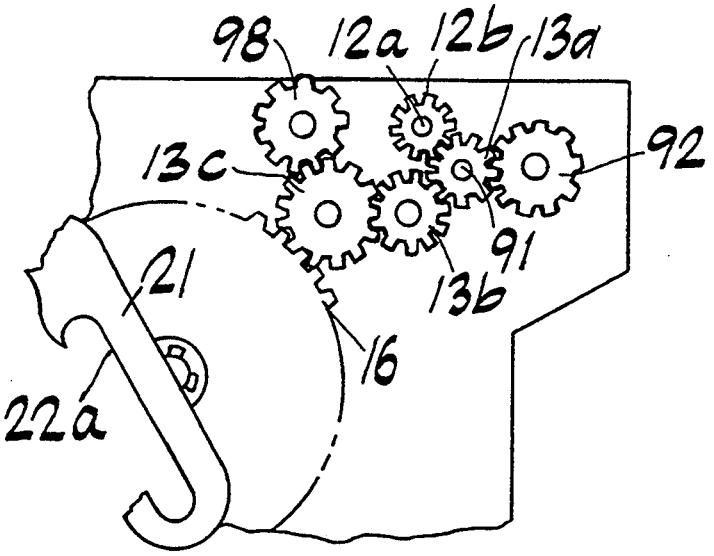
FIG. 11*a* is a side elevational view of the gear train of the stapler including a manually turnable gear unit.
Figure 11B:
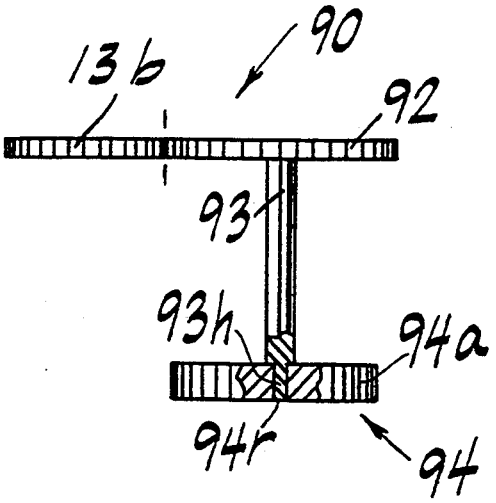
FIG. 11*b* is a plan view of the manually turnable gear unit of FIG. 11*a;*

Turning to FIGS. 11 and 11*a*, the stapler of the present invention may include an arrangement for manual movement of swingable head 26 upwardly when a jam occurs using turnable units. A jam normally engages and holds the paper sheets being stapled until head 26 is raised. To manually raise head 26 gear 13*a* on shaft 91, a gear in the gear train and the gear which directly engages the motor shaft gear 12*a*, is rotated by manual unit 90 which unit includes turnable gear 92 fixed on shaft 93. At the other end of shaft 93 having a length such that wheel 94 is at an accessible location outside the stapler housing or other accessible point, there is positioned thumb manually turnable wheel 94. Shaft 93 has a square head 93*h*. Thumb wheel 94 has a square recess 94*r* mating with head 93*h* and includes serrations 94*a* for easier gripping.

Figure 12:
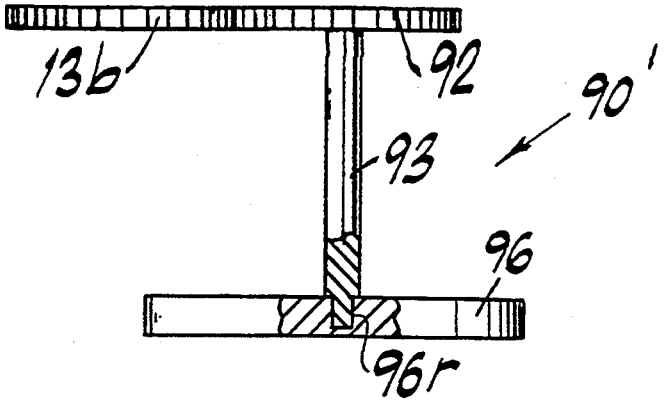
FIG. 12 is a plan view of an alternative hand-turnable unit.
Figure 12A:
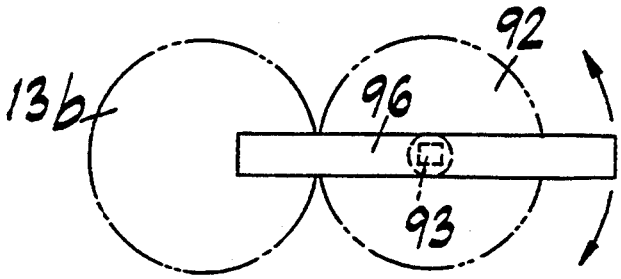
FIG. 12*a* is a side elevational view of the FIG. 12 unit.

In FIGS. 12 and 12*a* an alternative turnable unit 90' is shown in which thumb wheel 94 has replaced by an elongated hand crank 96 which crank is removable for storage between jams. Crank 96 has a square recess 96*r* which, by forced-frictional fit, receives the square head of shaft 93*h*.

Figure 13:
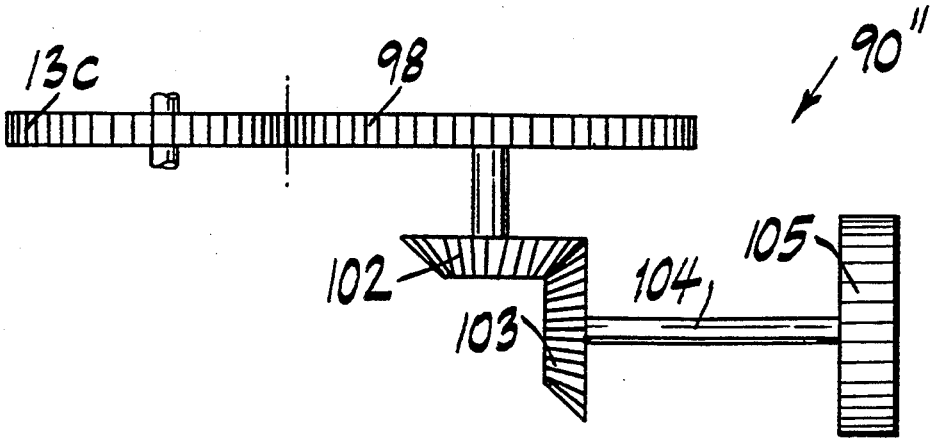
FIG. 13 is a plan view of a third alternative hand-turnable unit.

Finally, turning to FIG. 13, a third turnable unit 90'' is shown which engages gear 13*c* of the gear train, the gear next to the main drive gear 16 which caused head 26 to move up and down. Gear 98 and its associated shaft includes first bevel gear 102. Bevel gear 102 engages second bevel gear 103 which has shaft 104 and turnable manual thumb wheel 105.

I claim:

1. In a stapler having a frame, a head, a driver blade and one or more pivotal arms for controlling and driving said drive blade, the improvement comprising:

a) said one or more pivotal arms having a first exterior surface and a second exterior surface spaced apart by a selected distance which distance is the pivotal arm thickness;

b) an elongated follower cam slot extending between said exterior surfaces in the interior of said one or more pivotal arms, said slot having only one continuous wall having a width equal to said one or more pivotal arms thickness;

c) a driven rotatable gear mounted on an axle rotatable in the frame;

d) a pin on said driven gear which rotates with the gear, which pin rides within and along such wall of the cam slot to cause said one or more pivotal arms to pivot;

e) clinching wings mounted on the frame and pivotable upwardly and downwardly;

f) a staple clinching arm unit including a clinching arm and pivot means on the frame for pivotally connecting said clinching arm to the frame, wherein said clinching arm engages said wings to cause said wings to pivot upwardly and to pivot downwardly; and a pivot arm shaft about which said one or more pivotal arms pivots, said pivot arm shaft passing through frame slots substantially larger than the pivot arm shaft, said pivot arm shaft being resiliently mounted to permit the pivot arm shaft to move upwardly or downwardly within said frame slots depending on the thickness of the work being stapled.

2. The stapler of claim 1 in which there are two pivotal arms.

3. The stapler of claim 1 in which a motor shaft drives a first gear, wherein said first gear engages one of a plurality of reduction gears, wherein said first gear and said reduction gears lie substantially in a plane.

4. The stapler of claim 3 having a manually operable turnable unit for turning one of said reduction gears in order to manually raise the stapler head.

5. The stapler of claim 1 in which said clinching wings have upper surfaces at an angle to the horizontal to cause staple legs of a staple as it is clinched to move away from one another.

6. The stapler of claim 1 having in addition a motor, a switch means for supplying electricity to the motor, and having eccentric means on the driven rotatable gear for engaging and raising the clinching arm and for thereafter engaging the switch means to terminate electricity to the motor.

* * * * *